US007524133B2

(12) United States Patent
Messerschmidt et al.

(10) Patent No.: US 7,524,133 B2
(45) Date of Patent: Apr. 28, 2009

(54) SURFACE WATER DRAINAGE SYSTEM

(75) Inventors: Heino Messerschmidt, Lutjenwestedt (DE); Michael Sieber, Timmaspe (DE); Markus Blaschke, Fockbek (DE); Arne Stoltenberg, Budelsdorf (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 322 days.

(21) Appl. No.: 10/563,532

(22) PCT Filed: Jun. 24, 2004

(86) PCT No.: PCT/EP2004/006844

§ 371 (c)(1),
(2), (4) Date: Dec. 20, 2005

(87) PCT Pub. No.: WO2004/113632

PCT Pub. Date: Dec. 29, 2004

(65) Prior Publication Data

US 2006/0159515 A1 Jul. 20, 2006

(30) Foreign Application Priority Data

Jun. 25, 2003 (DE) ..... 103 28 612

(51) Int. Cl.
*B65D 90/10* (2006.01)

(52) U.S. Cl. ..... 404/4

(58) Field of Classification Search ..... 404/2, 404/4, 25; 405/118, 36; 137/371
See application file for complete search history.

(56) References Cited

U.S. PATENT DOCUMENTS 4,101,154 A * 7/1978 Kagstrom ..... 292/237
4,382,414 A * 5/1983 Svirklys ..... 108/56.1
4,553,874 A * 11/1985 Thomann et al. ..... 404/4
4,943,184 A * 7/1990 Humpherys et al. ..... 405/39
5,056,955 A * 10/1991 Spiess et al. ..... 404/25
5,987,824 A * 11/1999 Fuller ..... 52/19
6,106,706 A * 8/2000 Roy et al. ..... 210/99
6,132,137 A * 10/2000 Gunter ..... 405/36
6,306,293 B1 * 10/2001 Schilling et al. ..... 210/164
6,531,059 B1 * 3/2003 Morris et al. ..... 210/164
6,793,439 B1 * 9/2004 Arm et al. ..... 405/43
6,866,442 B1 * 3/2005 Petersen ..... 403/326
6,945,733 B2 * 9/2005 Rathmann et al. ..... 405/118
2004/0126187 A1 * 7/2004 Rathmann et al. ..... 405/40
2004/0240941 A1 * 12/2004 Sieber et al. ..... 405/118
2005/0238436 A1 * 10/2005 Wallace et al. ..... 405/118

FOREIGN PATENT DOCUMENTS

CH 681313 2/1993

(Continued)

*Primary Examiner*—Gary S Hartmann
(74) *Attorney, Agent, or Firm*—Hamre, Schumann, Mueller & Larson, P.C.

(57) ABSTRACT

A surface water drainage system according to the present invention includes a structure that can be installed in the ground, and a cover that can be laid onto an upper edge of the structure. Fixation devices that are attached to the cover include a locking system in a form of elastic hook elements fixed to edges of the cover that can be brought into snap-on engagement with other locking system on the structure in order to retain the cover on the structure.

11 Claims, 4 Drawing Sheets

FOREIGN PATENT DOCUMENTS

| | | |
|---|---|---|
| DE | 27 27 790 | 1/1979 |
| DE | 195 11 788 | 10/1996 |
| DE | 200 10 316 | 10/2001 |
| DE | 202 00 509 | 3/2002 |
| DE | 100 53 823 | 7/2002 |
| DE | 102 08 729 | 4/2003 |
| EP | 0 345 222 | 12/1989 |
| EP | 0 718 446 | 6/1996 |
| EP | 0 866 041 | 9/1998 |
| WO | WO 02/075066 | 9/2002 |
| WO | WO 02/090675 | 11/2002 |

* cited by examiner

SURFACE WATER DRAINAGE SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a surface water drainage system, in particular a drainage channel.

BACKGROUND OF THE INVENTION

A surface water drainage system of this kind is known, for example, from the documents CH 681 313 or DE 195 11 788 A1.

The problems generally encountered with such drainage systems, in particular drainage channels, are associated with the fact that on one hand the cover lying on the structure installed in the ground must be fixed in position so firmly that even the impulse-like forces encountered when a vehicle travels over the covers cannot release them. On the other hand, the covers must be opened at regular intervals so that cleaning and maintenance work can be done.

In the above-mentioned known surface water drainage systems a latch is attached to the undersurface of the cover, which bridges the cross section of the cover and/or the drainage channel equipped with said latch, and by way of lateral projections locks into undercut areas or recesses provided in the channel body.

The structure of the known systems is relatively elaborate and hence costly.

BRIEF SUMMARY OF THE INVENTION

It is the object of the invention to provide a surface water drainage system of the kind cited at the outset further, in such a way that manufacture and assembly are simplified while still ensuring at least equal durability and reliability of fixation.

According to one aspect of the present invention a surface water drainage system comprises a structure adapted for installation in the ground such that it defines an upper edge and comprising a first locking means; a cover adapted for location on the upper edge of the structure and fabricated from sheet metal having edges forming U-shaped profiles with undercut sections that face toward one another and with a lower side forming a supporting rim; and fixation devices attached to said edges of the cover and comprising second locking means in the form of elastic hook elements that are mounted within said undercut sections and that are adapted for snapping engagement with said first locking means on the structure in order to retain the cover on the structure. According to another aspect of the invention a surface water drainage system comprises a structure adapted for installation in the ground such that it defines an upper edge and comprising a first locking means; a cover comprising a cast metal grating adapted for location on the upper edge of the structure and having edges defining recesses; and fixation devices attached to said edges of the cover and comprising second locking means in the form of elastic hook elements that are inserted into said recesses and that are adapted for snapping engagement with said first locking means on the structure in order to retain the cover on the structure.

The essence of the invention resides in the fact that the locking means associated with the cover are constructed as elastic hook elements and are attached to the edges of the cover. This measure results in a considerable saving of material, because it eliminates regions of the latches provided in the known arrangements that are superfluous with respect to the actual purpose of fixation, being situated in the middle regions of the cover. An additional result is an increase in both durability and fixation performance. That is, whereas in the known systems releasing the snap engagement at one side of the latch or releasing the latch from the grid causes the entire cover no longer to be retained on the structure installed in the ground, in the arrangement according to the invention the locking means on the two sides, i.e. at the edges of the cover, are independent of one another. If one of the locking means is released, the other remains in place unaltered and can continue to perform its fixation function.

The object cited above is thus achieved by a surface water drainage system, in particular a drainage channel, comprising a structure that can be installed in the ground, a cover that can be laid onto an upper edge of said structure, and fixation devices that are fixed to the cover. These fixation devices comprise locking means in the form of elastic hook elements fixed to the edges of the cover that can be brought into snap-on engagement with other locking means disposed on the installed structure to hold the cover onto said structure.

Preferably the second locking means are detachably fixed to the cover. This makes it possible to exchange these locking means (individually) in case they exhibit material fatigue and/or are damaged in other ways.

Exchanging of the locking means is facilitated by the fact that they are preferably fixed to the cover by a mechanism that does not require use of a tool.

The second locking means preferably comprise fixation elements that can be deformed with less force when they are being fixed to the cover than when they are being removed from the cover. As a result, on one hand easy assembly is ensured (in the factory or during repair work), while on the other hand the fixation elements hold the locking means securely to the cover.

The second locking means are preferably inserted into undercuts or recesses at the edge of the cover. Thus production of the cover no longer requires the additional expenditure that is otherwise necessary for separate devices with which to attach the locking means.

The second locking means preferably comprise tensioning devices that brace them against the cover so as to ensure that they are fixed in position with no play. As a result, the cover is held to the structure installed in the ground so tightly that it does not rattle.

In a first preferred embodiment the second locking means are constructed as springs, by bending strips of material. This makes their manufacture relatively inexpensive. In this case the second locking means are preferably fixed to undercut regions in the cover by means of tabs bent outward from the strip of material. As a result, on one hand easy manufacture with unaltered consumption of material is ensured, while on the other hand the attachment between locking means and cover is extremely durable. Furthermore, in this embodiment the cover is provided in its undercut sections with stamped-out areas or similar offsets, which can be engaged by the said tabs in order to fix the locking means to the cover. The durability of this arrangement is very high, and the effort of manufacture is low.

In a second preferred embodiment the second locking means are constructed as elastomer bodies. Such bodies can be easily and economically produced, especially by injection molding, and exhibit great durability, which is very important in particular in view of the aggressive environmental influences (water, road salt, dirt) encountered in this area of application.

Exemplary embodiments of the invention will now be described with reference to the accompanying drawings.

DETAILED DESCRIPTION OF THE INVENTION

Figure 1:
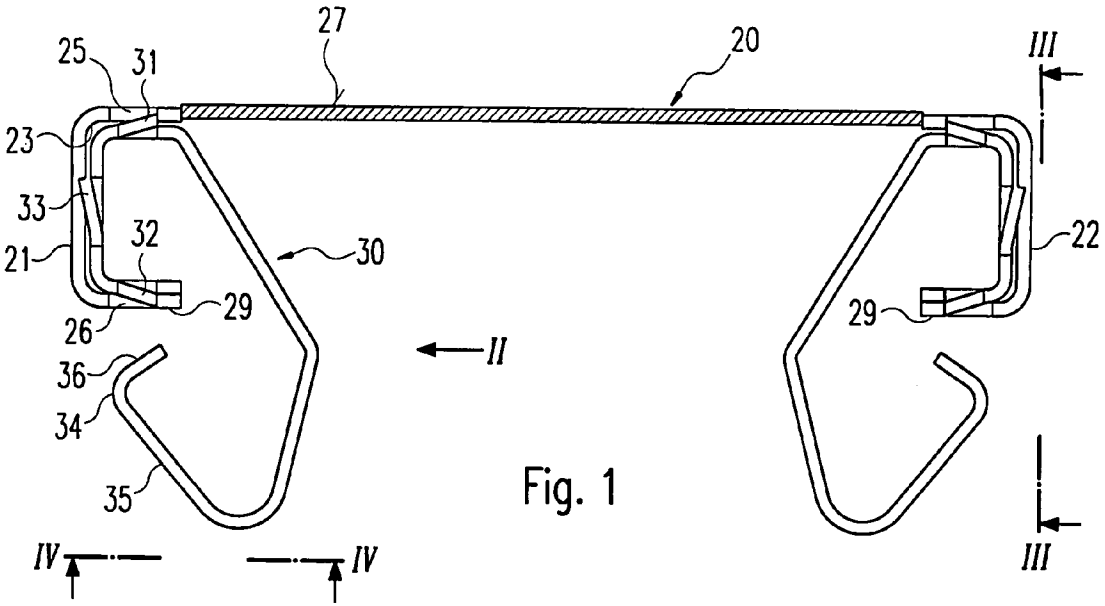
FIG. 1 shows a first embodiment of the invention, including cover, in front view.
Figure 3:
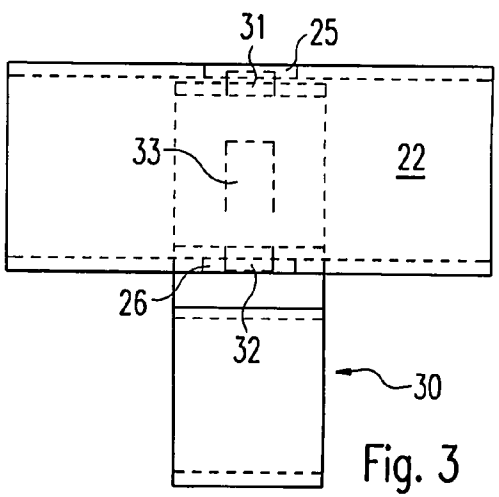
FIG. 3 shows a side view along the line III-III in FIG. 1.

In the following description, the same reference numerals are used for identical parts and parts with identical actions.

Figure 6:
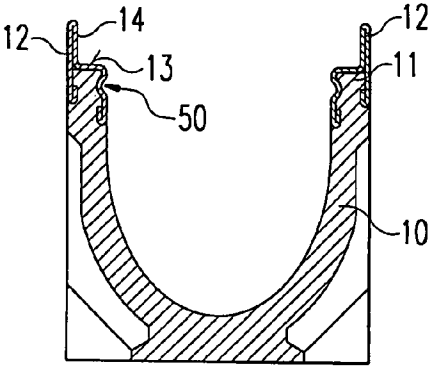
FIG. 6 shows a cross section through a drainage channel that can be installed in the ground.
Figure 7:
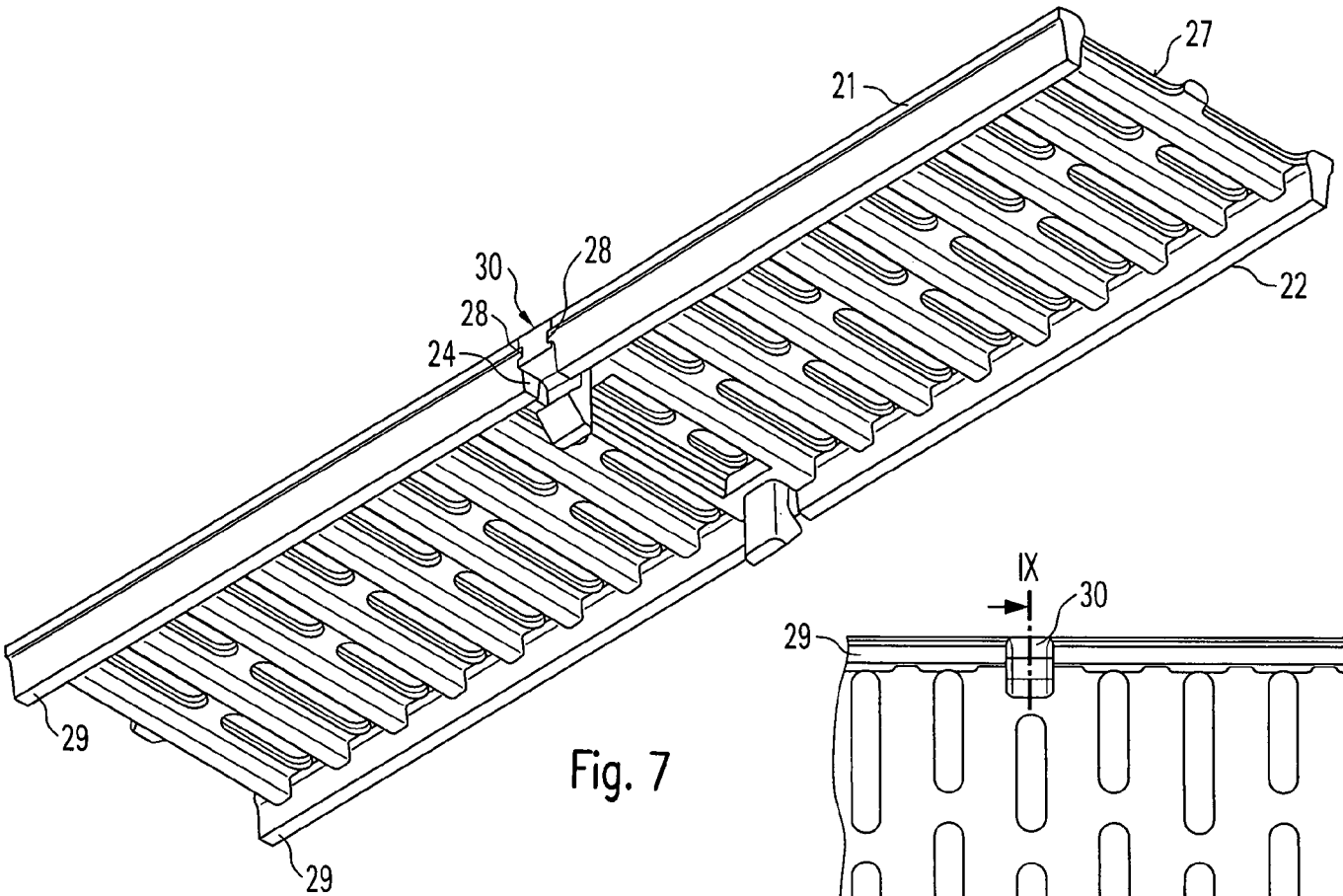
FIG. 7 shows a perspective view, from diagonally below, of another embodiment of the invention with a cast-iron grating as cover.
Figure 8:
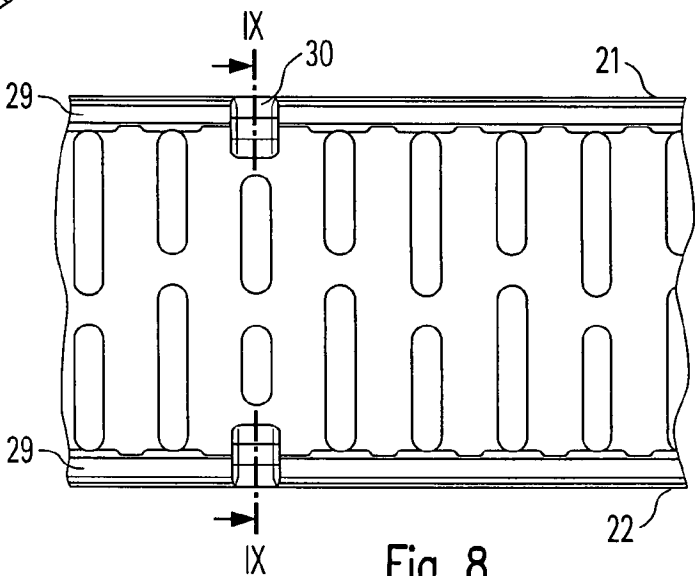
FIG. 8 shows a partial plan view of the arrangement according to FIG. 7.
Figure 9:
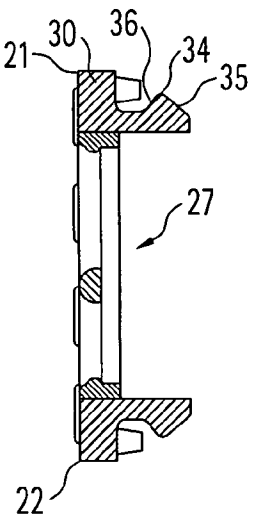
FIG. 9 shows a section along the line IX-IX in FIG. 8.
Figure 12:
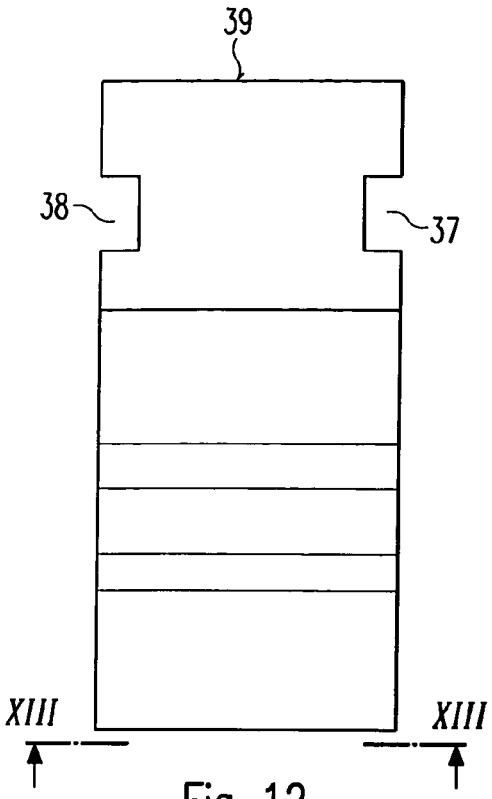
FIG. 12 shows a view along the line XII-XII in FIG. 11.
Figure 11:
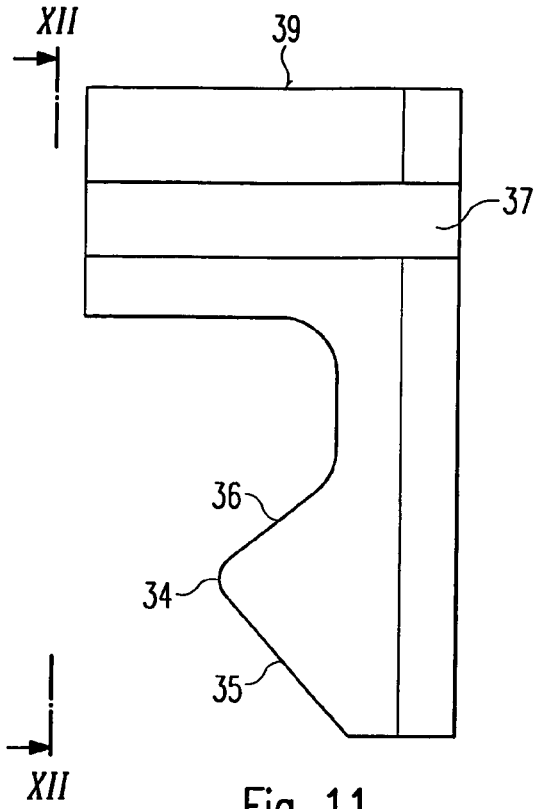
FIG. 11 shows a side view of the locking device according to FIG. 10.
Figure 13:
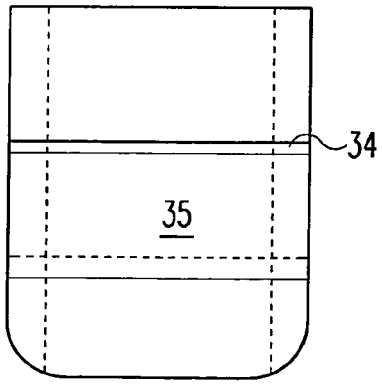
FIG. 13 shows a view along the line XIII-XIII in FIG. 12.
Figure 10:
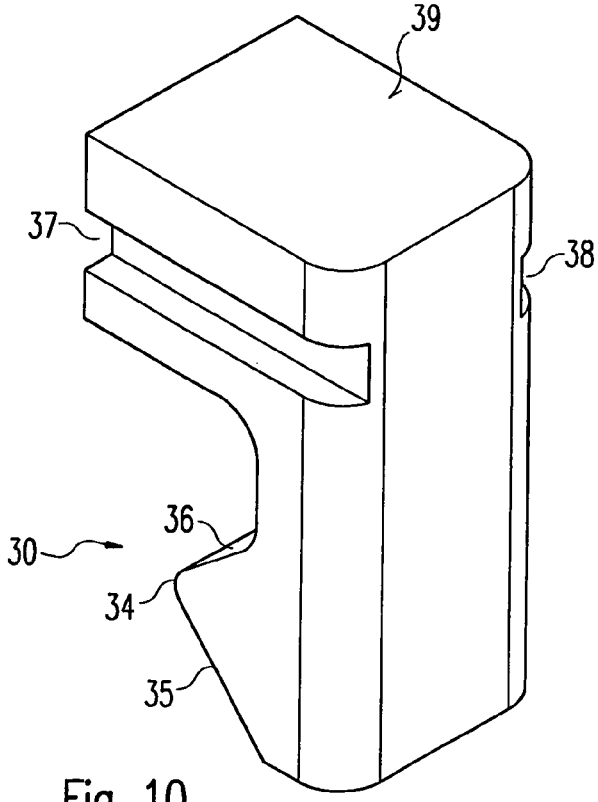
FIG. 10 shows a perspective view of a locking device according to FIG. 7.

In the arrangement shown in FIGS. 1 to 4 the cover 20 has been shaped by bending sheet steel. The edges 21, 22 in this case form undercut sections 23, each of which has a U-shaped profile with a supporting rim 29 on its lower side. The cover 20 is laid into a drainage channel such as is shown in FIG. 6, in such a way that the edges 21, 22 are apposed to inner surfaces of lateral folds 14, which are formed by frames 12 that are attached to or poured into the upper edges 11 of a structure 10 that can be installed in the ground. The frames 12 additionally form bearing surfaces 13 on which the cover 20 rests, by way of its supporting rims 29.

Within the undercut sections 23 hook elements 30 are disposed, to serve as first locking means. In the region where they are situated the contour (in cross section) of the hook elements 30 is identical to the contour of the undercut section, i.e. it is likewise U-shaped, so as to ensure that the hook elements 30 formed from a strip of material make contact over their entire surface.

Parts of the horizontal (in the assembled state) regions of the hook elements 30 are bent outward to form an upper tab 31 and a lower tab 32, which thus project beyond the otherwise planar upper and lower horizontal surfaces of the hook elements 30. Corresponding to these tabs, stamped-out areas are provided in the edges 21 and 22, specifically on the surface 27 of the cover 20 and in the supporting rims 29, so that in the assembled state the tabs 31, 32, by way of their edges directed toward the interior of the channel, are firmly engaged with the corresponding edges of the stamped-out areas 25, 26. To ensure that this engagement is maintained even if the cover is manufactured with relatively large tolerances, additional tabs are bent outward on the surfaces of the hook elements 30 that face toward the edges 21, 22; these act as tensioning tabs 33. By pressing against the inner (vertical) surfaces of the undercut section 23, these tensioning tabs press the hook elements 30 in the direction towards the interior of the channel.

Each hook element 30 comprises a nose 34, underneath which there is an insertion slope 35 and above which there is an unlatching slope 36. Thus when a cover 20 with hook elements 30 mounted therein is set onto the structure 10, at first the insertion slopes 35 slide along the inner edges of the frames 12 and bend the hook elements 30 inward. In the position in which the supporting rims 29 come to rest on the bearing surfaces 13, the noses 34 are caught in notches 50 in the frames, which serve as second locking means. These notches 50 are formed in the frames 12 over the entire length of the latter, which enables particularly simple manufacture of the frames.

The cover 20 is removed by simply pulling it upward, so that the unlatching slopes 36 slide along the inside edges of the frame 12 and bend the hook elements inward again.

Figure 5:
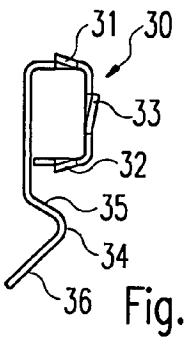
FIG. 5 shows a side view of a locking device according to another embodiment of the invention.
Figure 4:
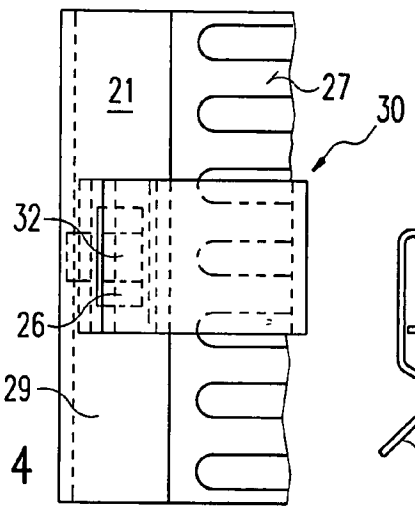
FIG. 4 shows a partial view in the direction of the line IV-IV in FIG. 1.
Figure 2:
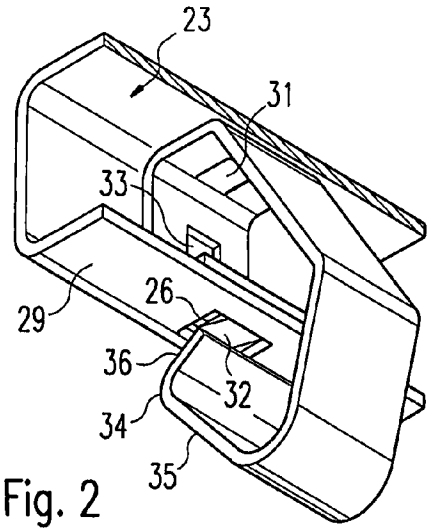
FIG. 2 is a perspective drawing of part of the structure in the direction indicated by the arrow II in FIG. 1.

In the embodiment of the hook element 30 shown in FIG. 5 the same basic functions are provided as in the embodiment previously described. However, the spring is somewhat slimmer and uses up less material.

In the following another embodiment of the invention is explained with reference to FIGS. 7 to 13. Here the cover 20 is a cast-iron grating constructed in the conventional way. At the edges of the grating recesses 24 are provided, into which can be inserted the first locking means 30, which in this case are designed as elastomer bodies (in particular, injection-molded). So that these can be fixed within the recesses 24 of the cover 20, the hook elements 30 on both edges are provided with guide slots 37, 38, which engage closely with corresponding guide lugs 28 disposed at the inner edges of the recesses 24. In addition catch elements (not shown) can be provided in order to ensure improved retention of the hook elements 30 in the recesses 24.

The hook elements 30 are dimensioned such that their surfaces 39 are flush with the surface 27 of the cover 20.

The remaining functional components of the hook element 30, namely the nose 34, the insertion slope 35 and the unlatching slope 36, correspond to those in the previously illustrated embodiment of the invention.

Figure 14:
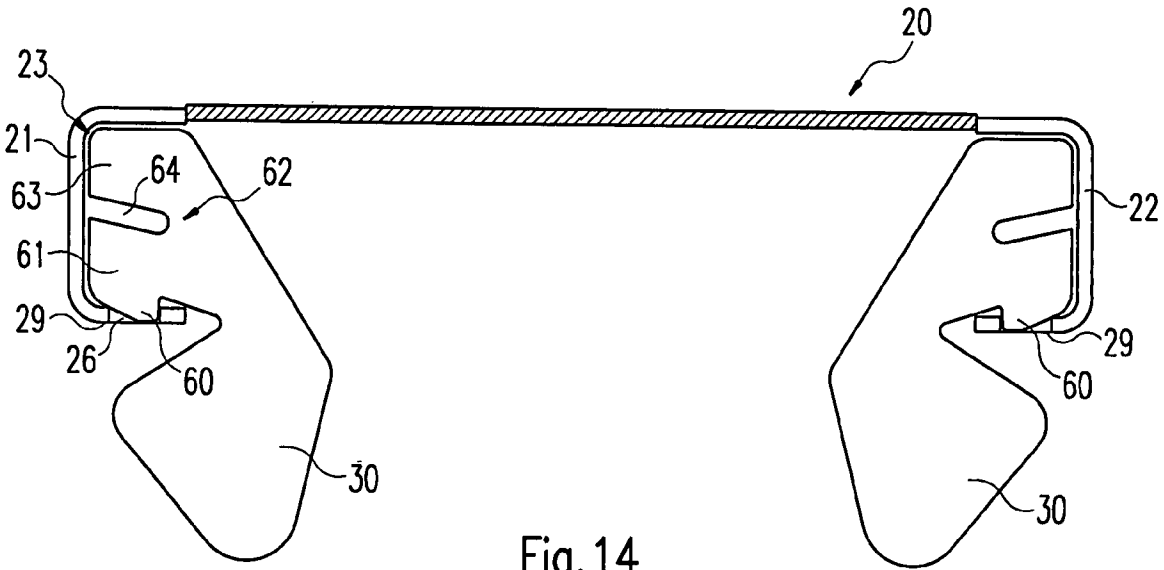
FIG. 14 shows a cross section through the cover, as well as locking element, in a third embodiment.
Figure 15:
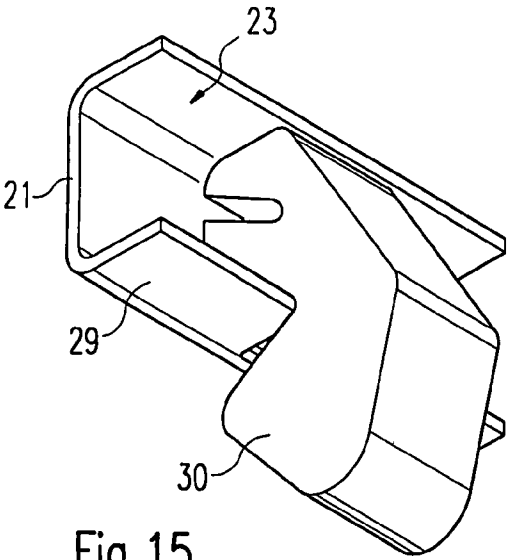
FIG. 15 shows an isometric partial view of the exemplary embodiment in FIG. 14.

It is of course possible to replace the hook elements formed by bending strips of material, as explained with reference to FIGS. 1 to 6, by elastomer elements according to FIGS. 10 to 13. This is illustrated in FIGS. 14 and 15 by another exemplary embodiment. Here, again, there is a cover 20 made by bending sheet steel. The edges 21, 22 each have undercut sections 23 with a U-shaped profile, the lower surface of which forms a supporting rim 29. The cover 20 is now, as in the exemplary embodiments previously discussed, laid into a drainage channel according to FIG. 6, with hook elements 30 positioned in the undercut sections 23 to serve as first locking elements. In contrast to the first exemplary embodiment, these hook elements are made of elastomer or a similar flexible material. However, in the region where they are inserted the contour of the hook element 30 is nearly identical to the contour of the undercut section 23, i.e. is likewise U-shaped, so as to ensure that the hook elements 30 make contact over their entire surface.

The hook elements 30 comprise in the horizontal (in the mounted state) region a lower projection 60 that engages a correspondingly shaped recess 26 in the supporting rim 29 of the cover 20. Furthermore, the insertion head 62 of the hook element 30 incorporates a slot 64, which divides the insertion head 62 into a lower insertion head 61 and an upper insertion head 63. In this case the height of the insertion head is somewhat greater than the vertical extent of the undercut section 23 formed in the cover 20. As a result, after the hook element 30 has been put into place, the insertion head 62 is compressed, which is made possible because the slot 64 allows the upper insertion head 63 and the lower insertion head 61 to move towards one another. Because of the elastic construction of the hook element 30, it becomes firmly wedged into the undercut section 23. Even when the cover 20 is subjected to dynamic loads, this arrangement ensures a permanently firm fixation of the hook element 30 within the undercut section 23 of the cover 20. Other advantages of a hook element 30 made of elastomer, of course, are its insensitivity to corrosion and the permanently fixed locking to the drainage channel. It is likewise possible in the case of a cast grating to employ hook elements that are correspondingly shaped by bending strips of material.

LIST OF REFERENCE NUMERALS

10. Underground structure
11. Upper edge
12. Frame
13. Bearing surface
14. Lateral fold
20. Cover
21. Edge
22. Edge
23. Undercut section
24. Recess
25. Stamped-out area
26. Stamped-out area
27. Surface
28. Guide nose
29. Supporting rim
30. Hook element/2nd locking means
31. Upper tab
32. Lower tab
33. Tensioning tab
34. Nose
35. Insertion slope
36. Unlatching slope
37. Guide slot
39. Surface
50. Notch/1st locking means
60. Projection
61. Lower insertion head
62. Insertion head
63. Upper insertion head
64. Slot

The invention claimed is:

1. Surface water drainage system, comprising:
a structure installed in the ground and having an upper edge with a frame thereon, said frame including a notch;
a cover having edges forming undercut sections with U-shaped profiles; and
a fixation device having a U-shaped portion and a portion with a nose, said U-shaped portion fitting within one of said undercut sections to lock said fixation device to said cover, said nose fitting within said notch to lock said cover to said structure.

2. Surface water drainage system according to claim 1, wherein said cover comprises a cast metal grating.

3. Surface water drainage system, comprising:
a structure installed in the ground and having an upper edge with a frame thereon;
a cover having edges forming undercut sections with U-shaped profiles; and
a fixation device with first means for locking said fixation device on said cover to said frame on said structure and with second means for locking said fixation device to one of said undercut sections of said cover.

4. Surface water drainage system according to claim 3, wherein said second locking means detachably fixes said fixation device to the cover.

5. Surface water drainage system according to claim 3, wherein said second locking means fixes said fixation device to the cover without use of tools.

6. Surface water drainage system according to claim 3, wherein said second locking means comprise flexible elements adapted such that less force is required to change a shape of the elements during mounting to the cover than during detachment from the cover.

7. Surface water drainage system according to claim 3, wherein said second locking means comprise tensioning devices that press the first locking means against the cover to ensure fixation without play.

8. Surface water drainage system according to claim 3, wherein said fixation device is constructed as a spring from a bent strip of material.

9. Surface water drainage system according to claim 8, wherein said fixation device is fixed within said undercut sections of the cover by means of a tab that has been bent outward from the strip of material.

10. Surface water drainage system according to claim 9, wherein the cover in the region of each of said undercut sections defines an aperture to engage the tab.

11. Surface water drainage system according to claim 3, wherein said second locking means comprise elastomer bodies.

* * * * *